United States Patent [19]

Wozniak

[11] Patent Number: 4,464,084

[45] Date of Patent: Aug. 7, 1984

[54] SHORING SUPPORTS

[75] Inventor: Jan C. Wozniak, Douglas, Isle of Man

[73] Assignee: Serni Limited, Douglas, Isle of Man

[21] Appl. No.: 442,587

[22] Filed: Nov. 18, 1982

[30] Foreign Application Priority Data

Dec. 1, 1981 [GB] United Kingdom ..... 8136222

[51] Int. Cl.[3] ..... E21D 11/15

[52] U.S. Cl. ..... 405/288; 52/667; 405/151

[58] Field of Search ..... 405/150–153; 403/347; 52/528, 667, 578, 588, 591, 594

[56] References Cited

U.S. PATENT DOCUMENTS

| | | | |
|---|---|---|---|
| 317,337 | 5/1885 | Goodridge | 405/150 |
| 777,013 | 12/1904 | Fernandez | 405/150 |
| 3,565,474 | 2/1971 | Stumbo et al. | 52/667 X |
| 4,211,504 | 7/1980 | Sivachenko | 405/284 |
| 4,314,432 | 2/1982 | Rosenbaum | 52/667 X |
| 4,317,318 | 3/1982 | Sauer | 52/667 |
| 4,317,641 | 3/1982 | Sauer | 52/667 X |

*Primary Examiner*—Dennis L. Taylor

*Attorney, Agent, or Firm*—Ross, Ross & Flavin

[57] ABSTRACT

In shoring a mine tunnel, use is made of a plurality of panels 11 each comprising a rectangular member with detents 15 formed in two opposed edges. The panel 11 may be composed entirely of sheet metal or may comprise spaced-apart rectangular or strips of sheet metal, with spaces between occupied by wire or rod mesh. The detents may comprise U-shaped tongues 18 defined by a C-shaped slot 16 and a T-shaped slot 17 the tongues acting in a hook like manner to interconnect the detents 15 on the superimposed edges of adjacent panels 11. Where the panel 11 is entirely of sheet metal, apertures 25 may be provided along the other pair of opposed sides for engagement of links such as 58; where the panel is partly of mesh such links can be looped through the mesh.

5 Claims, 5 Drawing Figures

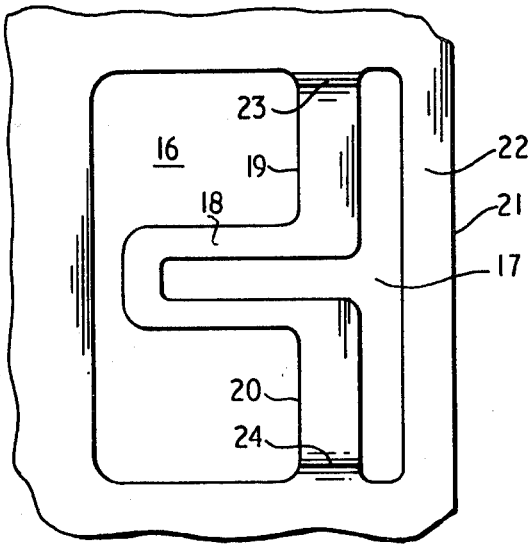
Fig.3.
Fig.4.
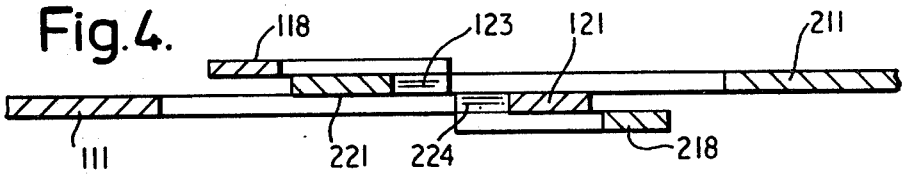
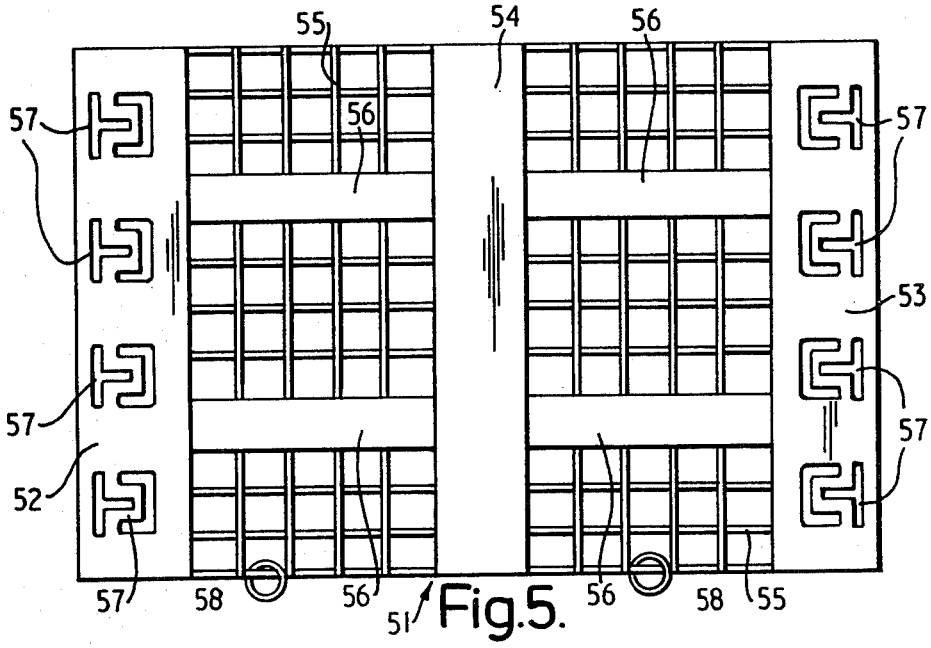
Fig.5.

SHORING SUPPORTS

TECHNICAL FIELD

This invention relates to improvements in shoring supports intended mainly but not exclusively for supporting walls and roofs of mine roadways.

BACKGROUND ART

An underground mine roadway generally comprises a tunnel, usually of arched construction. Because of the variable nature of underground strata, and the fact that coal measures rocks (i.e. rock strata containing coal seams) are frequently friable such as shales, or flowable such as clays, sands or stony layers, such tunnels have to be kept shored up or lined, and for safety's sake should be supported even when comprising massive bedded strata of limestone or sandstone. The shoring of such tunnels, according to various known proposals, comprises a plurality of spaced roof support arches or equivalent strut-and-beam structures in rectangular sectioned tunnels and shuttering for example of mesh, possibly reinforced by horizontal struts extending between the support arches. Such a shoring construction has the disadvantage that small debris can fall through the mesh of the shuttering, particularly in walls and roofs of tunnels through strata other than massive rocks. Such shuttering or lining mats are not capable of sectional interlocking construction.

An object of this invention is to provide an improved shoring support member for use in underground passageways wherein these disadvantages are obviated or minimised.

DISCLOSURE OF INVENTION

With this object in view the invention provides a tunnel wall shoring member comprising a substantially rectangular panel at least partially composed of sheet metal along at least two opposed sides of the panel, said two opposed sides of the panel each having one or more detents for connection with corresponding detents of a similar panel, the detents each comprising a tongue defined by slots and swaged to lie in a plane displaced from but parallel to the general plane occupied by the panel.

The sections may each comprise a sheet of mild steel or other suitable metal formed with spaced transverse corrugations to act as reinforcements.

The sections may each comprise a sheet of mild steel or other suitable metal formed with spaced transverse corrugations to act as reinforcements. Each section may have apertures at least on its intended vertical edges, and the apertures preferably have associated tongues for engaging in corresponding apertures in adjacent sections.

The intended horizontal edges may also be provided with apertures alignable with similar apertures on adjacent sections, so that the sections may be linked by suitable connectors, such as wire loops or forged links.

The sections may comprise homogenous structures such as sheets of mild steel, or may be compound structures, comprising mesh with at least edge strips of steel strip. Such a compound structure may comprise a panel of mesh with vertical edge strips, and horizontal reinforcement bars or strips extending across the mesh in a spaced array. Tongued apertures would be provided in the vertical edge strips, and the mesh itself would provide horizontal edge apertures for enabling linking of adjacent sections.

In such a structure, the mesh may be of lighter construction than that used in known lining mats as the mesh has only to support relatively small stones dislodged from the wall or roof, the weight of larger blocks being supported by the edge and any intermediate steel strips, and by the horizontal reinforcement bars or strips.

The edge apertures may be of a general C-shape, the bight of the "C" facing towards the respective edge, and receiving the leg of a "T" shaped slot, the aperture and T slot defining between them a generally "U" shaped tongue strip, which is swaged out of the general plane of the section. A narrow strip is also left between the cross-bar of the "T"-slot and the edge, and this may be swaged in the opposite sense out of the general plane, or remain in the general plane of the section. This configuration enables the tongues of adjacent slightly overlapped sections to engage in the respective "T" slots, and thereby rigidly connect the sections together. In building up a shoring construction, the sections in adjacent ranks or arches may be vertically stepped relatively to each other by a half section length, so that the sections are all interconnected thereby, connection on the horizontal edges may not then be required.

Gaps will occur in the shoring of a half section depth in alternate ranks or arches, but only at the foot of the tunnel walls where such gaps are of minimal importance.

BRIEF DESCRIPTION OF DRAWINGS

Preferred embodiments of the invention will now be described with reference to the accompanying drawings, wherein:

FIG. 3 is a detail showing the configuration of an aperture complete near an edge of the section;

FIG. 4 is a horizontal cross-section showing how the tongues and apertures of adjacent sections interlock;

FIG. 5 is a view similar to FIG. 2 of a variant embodiment of the invention;

DETAILED DESCRIPTION

An underground mine roadway or tunnel is supported in known manner by support arches 10, which may be of any known type, but are preferably as set forth in our British Patent Specification No. 1247348. The intermediate areas of tunnel wall and roof are supported by support sections 11 according to this invention, arranged in ranks or arches. The sections 11 in adjacent arches are staggered by a half length with respect of each other, so that each section is linked by connectors 12 to two other sections at each vertical edge, and the sections making up the complete shoring assembly are thus firmly interconnected. Gaps are left as at 13 at the lower sides of alternate arches, but this should occasion no danger. If required however half length sections may be used to cover such gaps.

Figure 1:
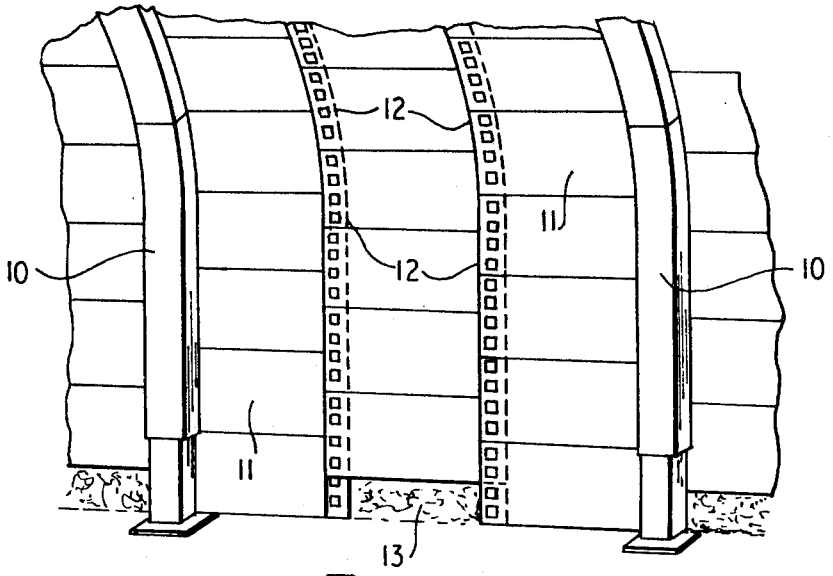
FIG. 1 is a view of a mine roadway wall showing the general arrangement of a tunnel shoring construction using support sections according to the invention.
Figure 2:
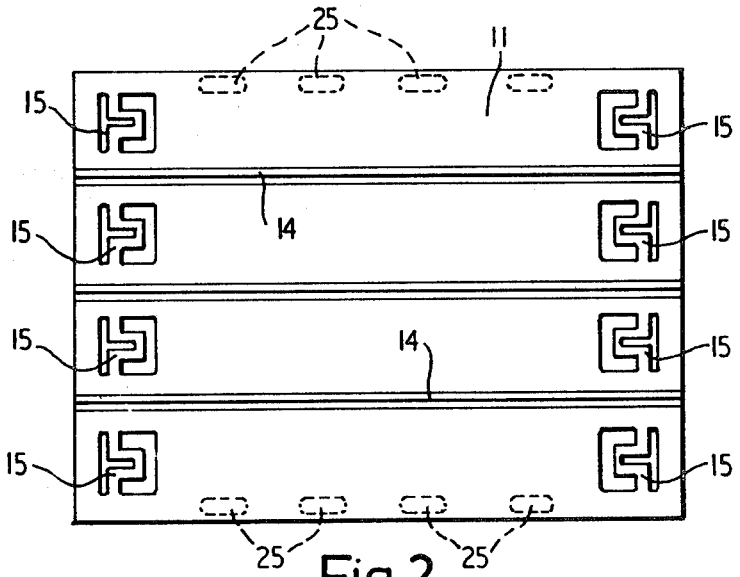
FIG. 2 is an elevation of one shoring section according to the invention.

In FIG. 2 one of the sections 11 is shown in greater detail. The section 11 comprises a generally rectangular sheet of mild steel, provided with transversely extending corrugations 14 of "V" section to increase the strength of the sheet. At each vertical edge (in position of use) are provided four aperture complexes 15 which overlap with similar aperture complexes in adjacent sections to form the connections 12. Each aperture complex 15, as better shown in FIG. 3, comprises a C-shaped aperture 16 and a T-shaped aperture 17 separated by a U-shaped tongue 18 connected by strips 19, 20 to the main body of metal of the section. The leg of the T-shaped slot forms the trough of the U-shaped tongue 18, and the bar of the T-shaped slot 17 forms with an adjacent edge 21 of the section 11 a strip 22. The tongue 18 is swaged outwardly at bends 23, 24 in strips 19, 20 to lie in a plane parallel to but above that of the main part of the section 11. The strip 22 may be oppositely swaged to lie in a plane below the plane of the section 11, or may lie in the same plane. The dotted line apertures 25 (FIG. 2) in the longitudinal edges of the sections 11 may be provided as optional edge connections of the sections by for example bolt or rivet type fasteners when edges are overlapped, or links, wire loops or the like when the edges are abutted.

FIG. 4 is a horizontal cross section through a connection 12 formed at the overlapping edges of a section 111 and a second section 211. The tongue 118, 218 respectively overlap the opposed edges 221, 121 and the latter butt against the swagings or bends 123/4 and 223/4. The connection can be locked by downward swaging of the edge strips 221, 121 so that they are joined against the opposing tongues 118, 218.

A possible second, less preferred, embodiment is illustrated in FIG. 5. A shoring section 51 comprises end strips 52, 53 of mild sheet steel, and a mid length strip 54 parallel to the latter. The spaces between these strips is occupied by a wire or rod mesh 55, and longitudinal stiffeners 56 extend transversely from side to side, perpendicular to strips 52, 53 and 54. Aperture and tongue complexes 57 each similar to that described with reference to FIG. 3 are provided in the end strips 52, 53 and are used to connect sections 51 in the manner described hereinbefore. The longitudinal edges of the sections can be connected by e.g. links 58 looped through the mesh 55.

I claim:

1. A tunnel wall shoring panel comprising:

a substantially flat member of metal of generally rectangular outline and having at least two opposed sides each having at least one detent for connection with the corresponding detents of a similar panel for retaining the panels in general alignment, the detents each comprising a tongue defined by slots in the form of an inner T-shaped slot having a crossbar disposed parallel to the adjacent edge of the panel and a leg disposed perpendicular to and extending away from the said adjacent edge and a C-shaped outer slot having a concave side directed towards the said adjacent edge and embracing the leg of the T-shaped slot, the tongue being defined between the slots and comprising a generally U-shaped strip and further being displaced from the plane of the panel into a generally parallel plane.

2. A tunnel wall shoring member according to claim 1 wherein the panel comprises a single sheet of metal.

3. A tunnel wall shoring member according to claim 1 wherein the panel comprises rectangular sheets of metal at each end of the opposed sides of the panel and separated by an area occupied by a mesh of rods.

4. A tunnel wall shoring member according to claim 2 wherein a series of detents is provided along each of the other sides of the panel for engagement of wire ties.

5. A tunnel wall shoring assembly comprising a plurality of shoring members each according to claim 1.

* * * * *